United States Patent [19]

Ball et al.

[11] Patent Number: 4,621,585

[45] Date of Patent: Nov. 11, 1986

[54] APPARATUS FOR FABRICATING PILLOWCASES

[75] Inventors: Gregory A. Ball, Mooresville; Byron E. Moore, Kannapolis; Hoyt W. Beam, Concord, all of N.C.

[73] Assignee: Cannon Mills Company, Kannapolis, N.C.

[21] Appl. No.: 776,651

[22] Filed: Sep. 16, 1985 (Under 37 CFR 1.47)

[51] Int. Cl.[4] ..... D05B 13/00

[52] U.S. Cl. ..... 112/10; 112/121.29; 112/147; 112/153; 112/304; 112/306; 112/121.11

[58] Field of Search ..... 112/121.11, 121.12, 112/121.15, 121.29, 147, 153, 304, 306, 10

[56] References Cited

U.S. PATENT DOCUMENTS

| | | | |
|---|---|---|---|
| 2,667,132 | 1/1954 | Golden | 112/10 |
| 2,726,611 | 12/1955 | Cloutier . | |
| 2,940,404 | 6/1960 | Damon | 112/10 |
| 3,013,513 | 12/1961 | Judelson . | |
| 3,126,848 | 3/1964 | Gastonguay . | |
| 3,203,386 | 8/1965 | Briggs . | |
| 3,224,394 | 12/1965 | Dobner et al. . | |
| 3,227,118 | 1/1966 | Gore . | |
| 3,227,119 | 1/1966 | Gore et al. . | |
| 3,461,825 | 8/1969 | Brown | 112/10 |
| 4,086,860 | 5/1978 | Kosrow et al. . | |
| 4,214,541 | 7/1980 | Zeigler, Jr. . | |
| 4,224,883 | 9/1980 | Zeigler, Jr. . | |
| 4,269,130 | 5/1981 | Burton et al. . | |
| 4,292,908 | 10/1981 | Blessing . | |
| 4,353,316 | 10/1982 | Brocklehurst . | |
| 4,388,879 | 6/1983 | Everall, Jr. . | |
| 4,462,322 | 7/1984 | Brocklehurst . | |

*Primary Examiner*—H. Hampton Hunter

*Attorney, Agent, or Firm*—Bell, Seltzer, Park & Gibson

[57] ABSTRACT

An apparatus and method for successively fabricating pillowcases and the like from a continuous open width textile fabric with each of the successively produced pillowcases including correctly aligned and stitched together hemmed open ends, and side and bottom edges. The fabric is withdrawn from a supply source and successively cut to form individual blanks of predetermined length. The blanks are moved along a substantially rectangular path of travel with the completed pillowcases being deposited in a position adjacent the supply source of the open width fabric. A folding station is provided for successively folding the hemmed blanks along a fold line extending longitudinally along the medial portion with the opposite side edges and the hem end in substantial overlying alignment with one another. A corner aligning station is provided for detecting an out of alignment condition of the leading ends of the hemmed end and overlying opposite side edges of the folded blank and for selectively advancing the upper and lower hemmed ends and overlying opposite side edges for aligning the leading ends thereof.

14 Claims, 15 Drawing Figures

APPARATUS FOR FABRICATING PILLOWCASES

FIELD OF THE INVENTION

This invention relates generally to an apparatus and method for fabricating pillowcases and the like, and more particularly to such an apparatus and method for automatically fabricating successive pillowcases and the like from continuous open width textile fabric with each of the successive pillowcases being identical and with properly aligned top, side and bottom edges.

BACKGROUND OF THE INVENTION

It is the common practice to manufacture pillowcases, bags and the like by sewing the hem, side and bottom seams in a series of successive manual operations with separate sewing machines and operators being used for each operation. This manual fabrication of pillowcases and the like requires a large number of sewing machine operators thereby adding to the labor costs of producing the pillowcases and requiring a large amount of space to position the separate operators and sewing machines.

In order to reduce the labor involved in forming pillowcases and to increase the production rate, several different types of apparatus have been proposed for automatically producing pillowcases and the like. For example, U.S. Pat. Nos. 3,126,848 and 4,388,879 disclose apparatuses for automatically producing pillowcases from tubular textile fabric. Similar types of apparatuses are disclosed in U.S. Patent Nos. 3,227,118; 3,227,119; 4,214,541; and 4,224,883 for forming pillowcases from a continuous open width textile fabric. While the apparatuses disclosed in these patents have been effective to reduce the labor costs involved in producing pillowcases and the like, they have not been completely satisfactory from the standpoint of the consistent production of identical pillowcases in which the open hem end, the side portion and the bottom are perfectly aligned and stitched together in such aligned condition.

OBJECT AND SUMMARY OF THE INVENTION

With the foregoing in mind, it is an object of the present invention to provide an apparatus and method which consistently forms successive pillowcases and the like from a continuous open width textile fabric with each of the successively produced pillowcases including correctly aligned top, side and bottom edges.

In accordance with the present invention, the continuous open width textile fabric is withdrawn from a supply source and successively cut to form individual blanks of predetermined length. The individual blanks are automatically moved along a substantially rectangular path of travel with the completed pillowcases being deposited in a position adjacent the supply source of the open width textile fabric.

The individual blanks are successively moved along a horizontal path of travel and in a widthwise direction from the cutting station and through hem forming and stitching stations. In the hem forming station, one cut end portion of each individual blank is folded over onto the remaining portion, and the folded hem is sewn in the hemming station.

A folding station is positioned for successively receiving the hemmed blanks and folding the blanks along a fold line extending transversely of the medial portion of the blank with the opposite side edges and the hemmed and bottom ends in overlying alignment with one another. The individual blanks are then successively conveyed along a horizontal path of travel in a lengthwise direction from the folding station, through a corner aligning station, and through a side seaming station.

The corner aligning station detects an out of alignment condition of the leading ends of the folded over hemmed end and overlying opposite side edges of the successive blanks. Aligning means is provided for selectively advancing the upper and lower hemmed ends and overlying opposite side edges for aligning the corner at the juncture of the hemmed ends and opposite side edges. The side seaming station is positioned for receiving the aligned side edges and sewing together the leading folded hem portion and the trailing side edges.

The individual blanks are then moved along a horizontal path of travel in a widthwise direction through a bottom seaming station and to a counting and stacking station. The bottom end seaming station is positioned for receiving and sewing together the overlying bottom ends of the successive blanks. The counting and stacking station is positioned for receiving the successive pillowcases from the bottom end seaming station and positioning a predetermined number of the pillowcases in successive stacks.

The above discussed folding station preferably includes a vertically reciprocating clamp for engaging and clamping the leading end of successive blanks and drawing the same downwardly a predetermined distance. A horizontally reciprocating fold bar is engageable with one side of the vertically extending portion of the blank for moving the same horizontally a predetermined distance to begin the folding of the blank. Clamp means is provided for engaging the partially folded blank in the area of the fold line to permit the fold bar to return to its original position and conveying means cooperates with the clamp means for moving the leading folded side of the blank away from the vertically reciprocating clamp means and for completing the folding of the blank.

The above mentioned corner aligning station preferably includes a selectively driven lower conveyor belt positioned to engage the lower surface of the lower layer of the side edge portion of the folded blank. A selectively driven upper conveyor belt is aligned above the lower conveyor belt and is positioned to engage the upper surface of the upper layer of the side edge portion of the folded blank. Retractable bar means is positioned between the lower and upper conveyor belts for engaging the inner surfaces of the lower and upper layers of the side edge portions of the folded blank. Means is provided in advance of the retractable bar means for separating the leading edges of the side edge portions of the folded blank to guide the same onto respective positions above and below the retractable bar means and for engagement by the lower and upper conveyor belts.

Respective upper and lower detector means, in the form of photoelectric cells, are provided for detecting the relative positions of the respective lower and upper leading edges of the folded blank being conveyed on the respective upper and lower surfaces of the retractable bar means. The photoelectric cells are operable to control operation of the lower and upper conveyor belts and to thereby vertically align the leading edges of the lower and upper layers of the blank.

The above mentioned counting and stacking station preferably includes first conveying means for engaging the seamed side edge portion of successive pillowcases downstream of the bottom end seaming station and for moving the same a predetermined distance before releasing the pillowcases and forming a stack thereof. The stack of pillowcases is deposited on additional conveying means and is operable to move a stack of a predetermined number of the pillowcases downstream of the stack on which the pillowcases are initially stacked by the first conveyor means.

BRIEF DESCRIPTION OF THE DRAWINGS

Some of the objects and advantages of the present invention having been set forth, other objects and advantages will appear as the description proceeds when taken in connection with the accompanying drawings, in which --

DESCRIPTION OF THE ILLUSTRATED EMBODIMENT

Figure 2:
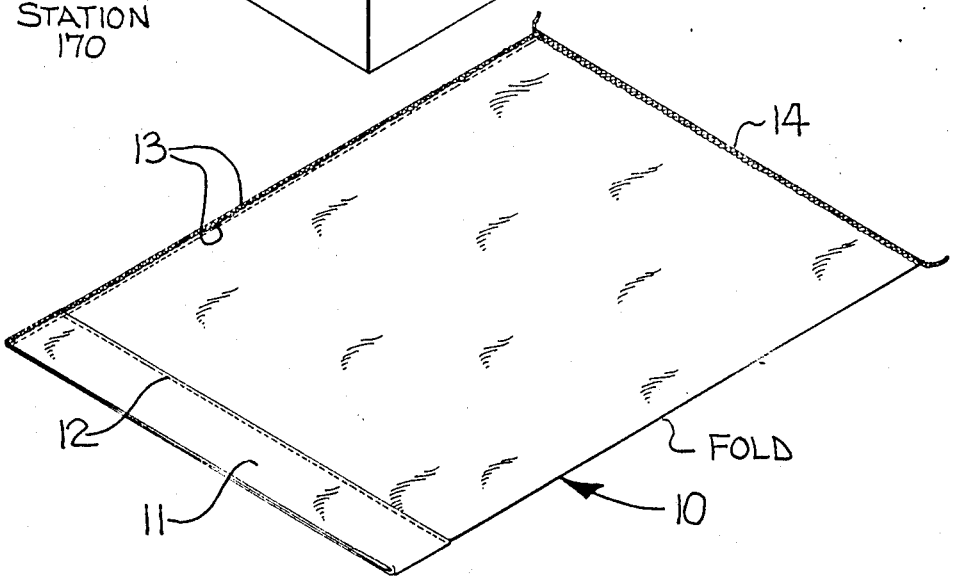
FIG. 2 is an isometric view of a completed pillowcase, in wrong-side-out condition, as produced by the apparatus of FIG. 1.
Figure 3:
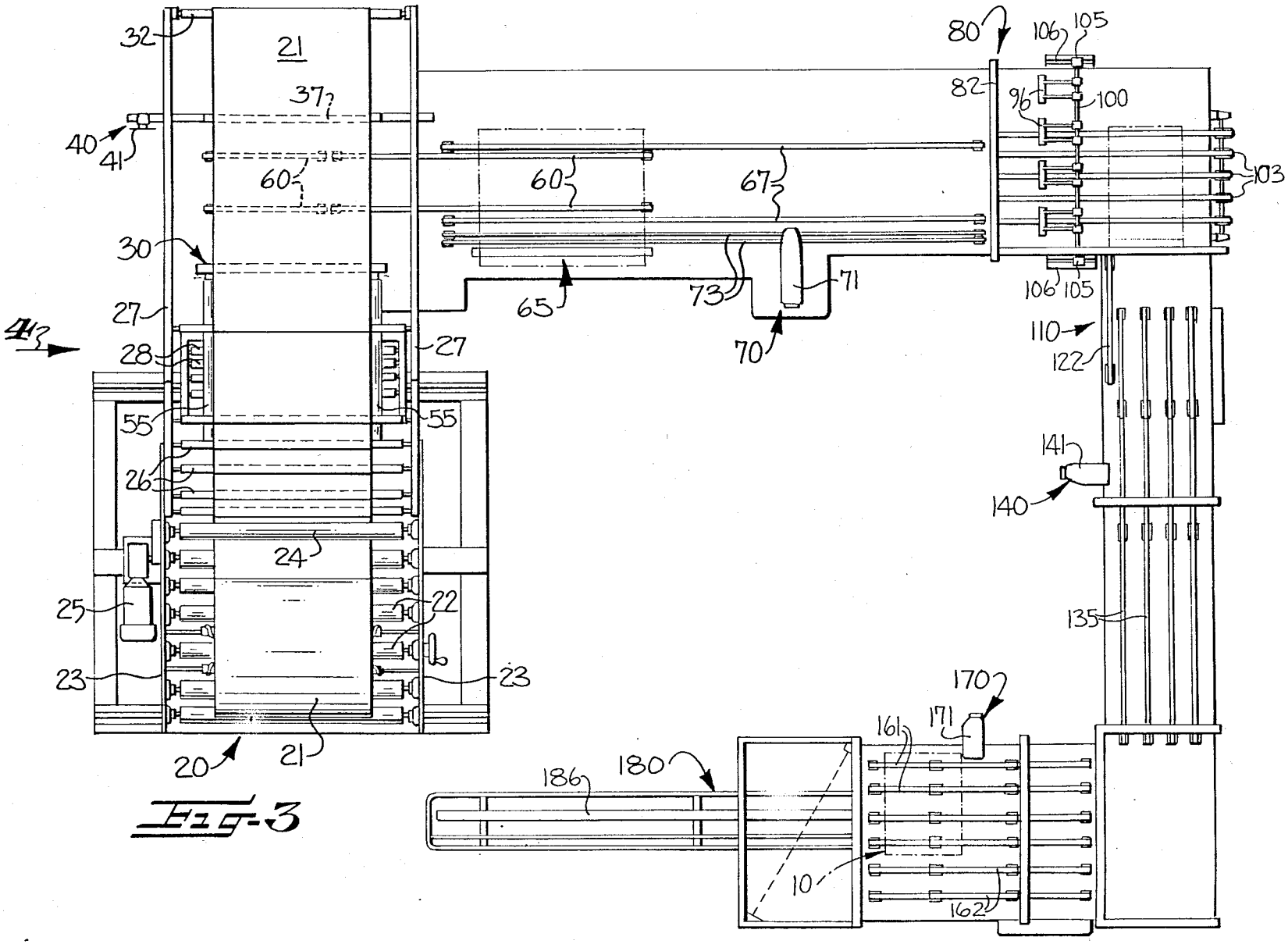
FIG. 3 is a somewhat schematic plan view of the apparatus illustrated in FIG. 1.

The apparatus and method of the present invention is particularly adapted for forming a pillowcase, broadly indicated at 10, and shown in FIG. 2 in a wrong-side-out condition. The pillowcase 10 includes an open entrance end with a wide hem 11 folded over and stitched to the remainder of the pillowcase by a line of stitching 12. Aligned opposite side portions are stitched together along one side of the pillowcase, as by overedge and straight lines of stitching 13, and the bottom edge of the pillowcase is closed by a row of overedge stitching 14. However, it is to be understood that the apparatus and method of the present invention may also be utilized in fabricating other similar types of articles from textile fabric, such as bags or the like.

Figure 1:
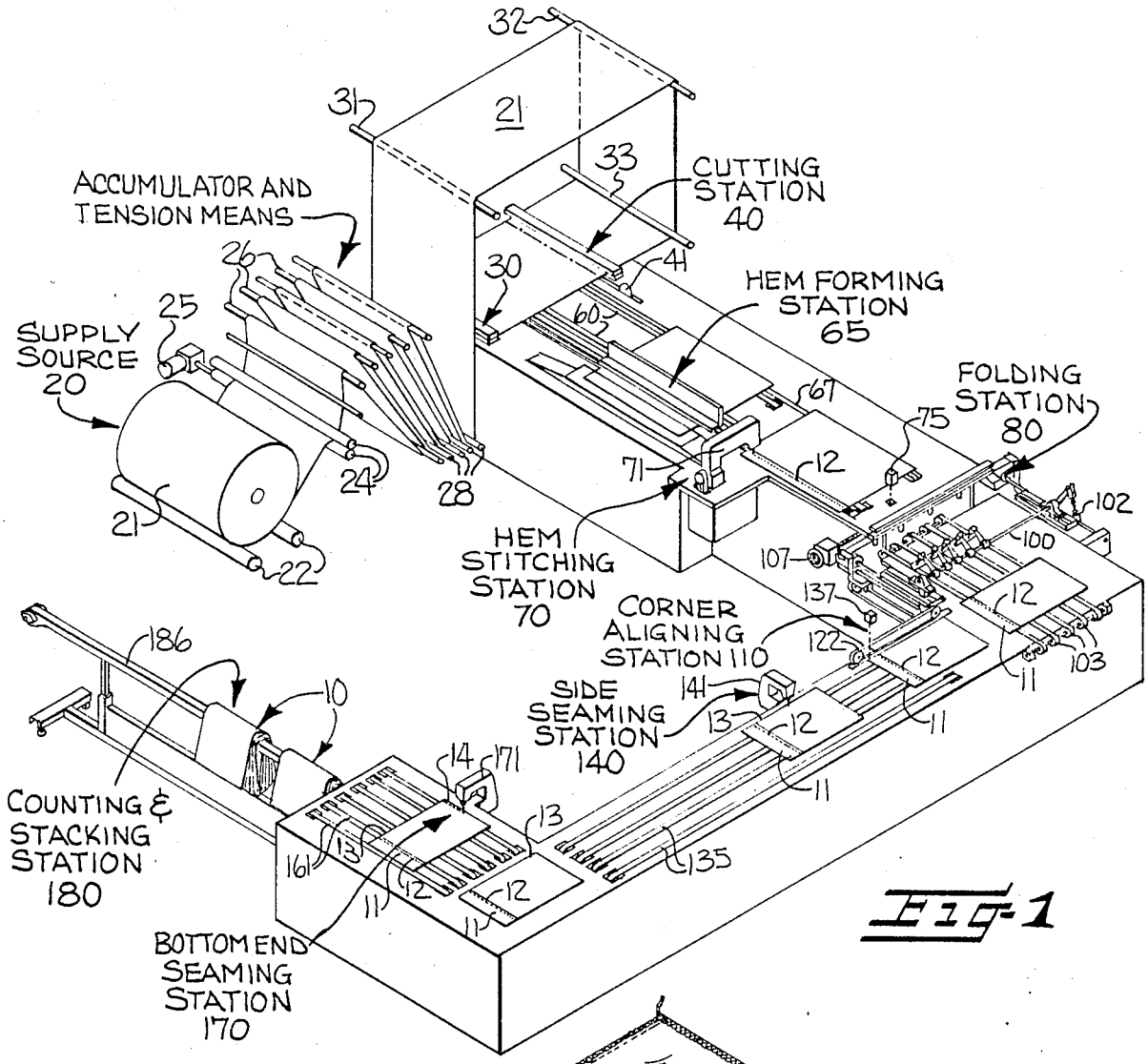
FIG. 1 is a somewhat schematic isometric view of a pillowcase forming apparatus constructed in accordance with the present invention.

As illustrated in FIG. 1, the apparatus of the present invention includes a supply source, broadly indicated at 20, illustrated as a roll of continuous open width textile fabric 21 with side edges extending along opposite sides thereof. The supply roll of textile fabric 21 is supported for rotation in cradle rolls 22 (FIG. 4) rotatably supported in opposite end frames 23.

Figure 4:
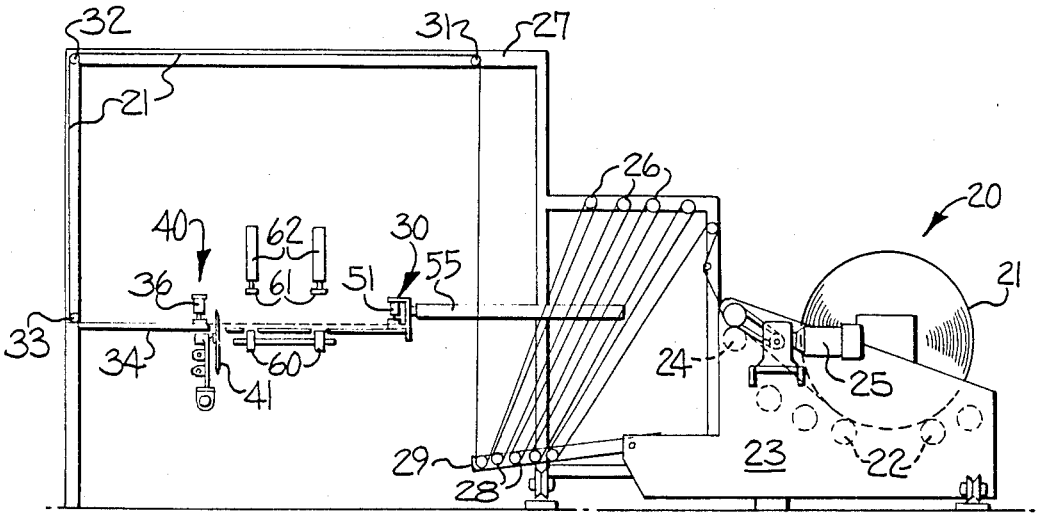
FIG. 4 is an elevational view looking inwardly at the left hand end of FIG. 3 in the direction of arrow 4.

Means is provided for successively withdrawing predetermined lengths of the textile fabric 21 from the supply source 20 and along a first horizontal path of travel in a lengthwise direction and includes feed roll means, in the form of a pair of nip drive rolls 24, positioned adjacent the supply source 20 and operable to withdraw predetermined lengths of the fabric 21 from the supply source in timed relationship to operation of the other pillowcase forming stations of the apparatus. Operation of the feed rolls 24 is controlled by a drive motor 25 supported on one of the frame members 23 (FIG. 4).

Fabric accumulator and tension means is positioned downstream of the feed rolls 24 for receiving and maintaining predetermined tension in the fabric 21 and includes an upper series of guide rolls 26 rotatably supported at opposite ends on side frames 27 and a lower series of guide rolls 28 rotatably supported at opposite ends on pivotally supported tension arms 29. Reciprocating fabric clamping means, broadly indicated at 30 (FIG. 5), is provided for clamping the leading end of the fabric 21 and moving the same a predetermined distance beyond the cutting location, to be presently described. As the fabric 21 leaves the accumulator and tension means, it is directed upwardly and around successive guide rolls 31, 32, and 33 (FIG. 4) in substantially an inverted U-shaped path of travel, and then horizontally across a support plate 34. The leading edge portion of the fabric 21 is held against withdrawal by a vertically movable clamping bar 35 which is supported by spaced air cylinders 36 fixed at their upper ends on a support bar 37 (FIGS. 5 and 6).

A cutting station, broadly indicated at 40, is positioned adjacent the clamping bar 35 and includes a driven circular cutting blade 41 (FIGS. 5 and 6) mounted for rotation on a carriage 42 which is supported for transverse sliding movement on guide rods 43. The lower portion of the carriage 42 is attached to an elongate rodless air cylinder 44 for back and forth movement in timed relation to the reciprocating fabric clamping means 30 for transversely cutting the textile fabric 21 into successive individual blanks of predetermined length.

The reciprocating fabric clamping means 30 includes an upper support bar 50 (FIG. 5) which has the upper ends of spaced apart air cylinders 51 fixed thereto and extending downwardly therefrom. The lower ends of the air cylinders 51 are fixed to the upper surface of an upper clamping bar 52 movable toward and away from a lower clamping bar 53. The support bar 50 and the clamping bars 52, 53 are supported for reciprocating movement on guide rods 54 and are moved back and forth by an air cylinder 55.

Figure 5:
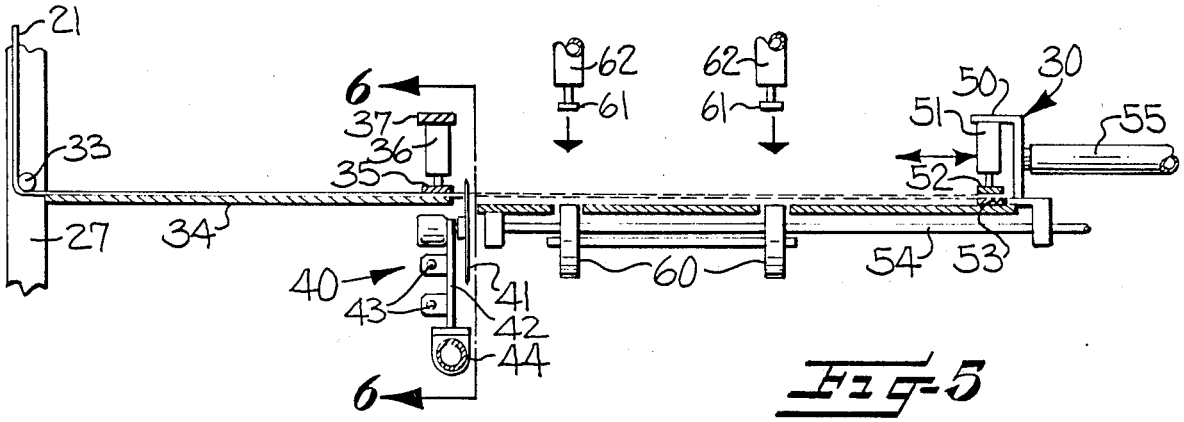
FIG. 5 is an enlarged fragmentary vertical sectional view of the left hand portion of FIG. 4.
Figure 6:
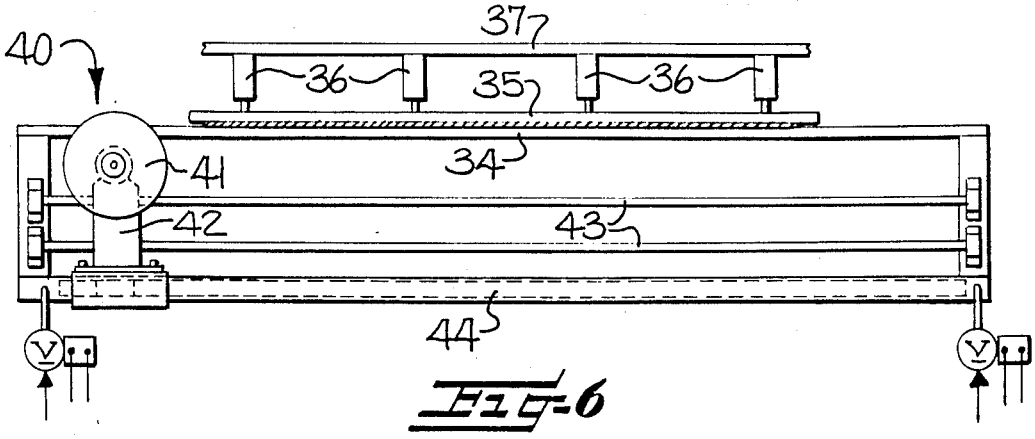
FIG. 6 is a vertical sectional view taken substantially along the line 6—6 in FIG. 5.

The air cylinder 55 is operated in timed relationship to the other operations of the apparatus and moves the clamping bars 52, 53 to the left in FIG. 5 so that the leading edge of the fabric 21 is clamped therebetween The air cylinder 55 then returns the fabric clamping bars 52, 53 to the position shown in FIG. 5, thus withdrawing a predetermined length of the fabric 21 from the supply source 20. The clamp bar 35 then engages the upper surface of the fabric 21 to hold the same in a tensioned condition while the cutter blade 41 traverses the width of the fabric to cut an individual pillowcase blank from the fabric 21 so that the pillowcase blank rests on the upper table surface of the frame of the apparatus.

Conveying means, in the form of a pair of spaced apart conveyor belts 60, is positioned with the upper reaches of the conveyor belts spaced slightly below the upper surface of the support table. Slide bars 61 are supported on the lower ends of air cylinders 62 (FIG. 5) and are movable downwardly to maintain the individual blank in frictional engagement with the upper reaches of the conveyor belts 60 so that the individual blanks are moved along a horizontal second path of travel in a widthwise direction from the cutting station 40 and to and through a hem forming station, broadly indicated at 65 in FIG. 1, for receiving the individual blanks and folding one cut end portion over onto the remaining portion thereof to form a hem of the desired wide width thereon.

The hem folding station may be of any suitable type and is preferably of the type illustrated in commonly owned application Ser. No. 745,326, filed June 14, 1985, and incorporated herein by reference. The hem forming apparatus of this pending application is of the type adapted to form a double-folded wide hem across one end of the pillowcase blank and extending from one side to the other. The blank with the folded hem is then moved in a widthwise direction, by additional conveyor belts 67, through a hem stitching station, broadly indicated at 70, and including a sewing machine 71 for stitching the folded hem, as indicated at 12 in FIG. 2, from one side edge to the other of the pillowcase blank. Suitable cutting means, not shown, is provided adjacent the hem stitching sewing machine 71 for cutting the stitch chain extending from the trailing side of the pillowcase blank. A pair of conveyor belts 73 (FIG. 7) extends parallel to the conveyor belts 67 and supports the pillowcase blank adjacent opposite sides of the seam line 12.

Figure 7:
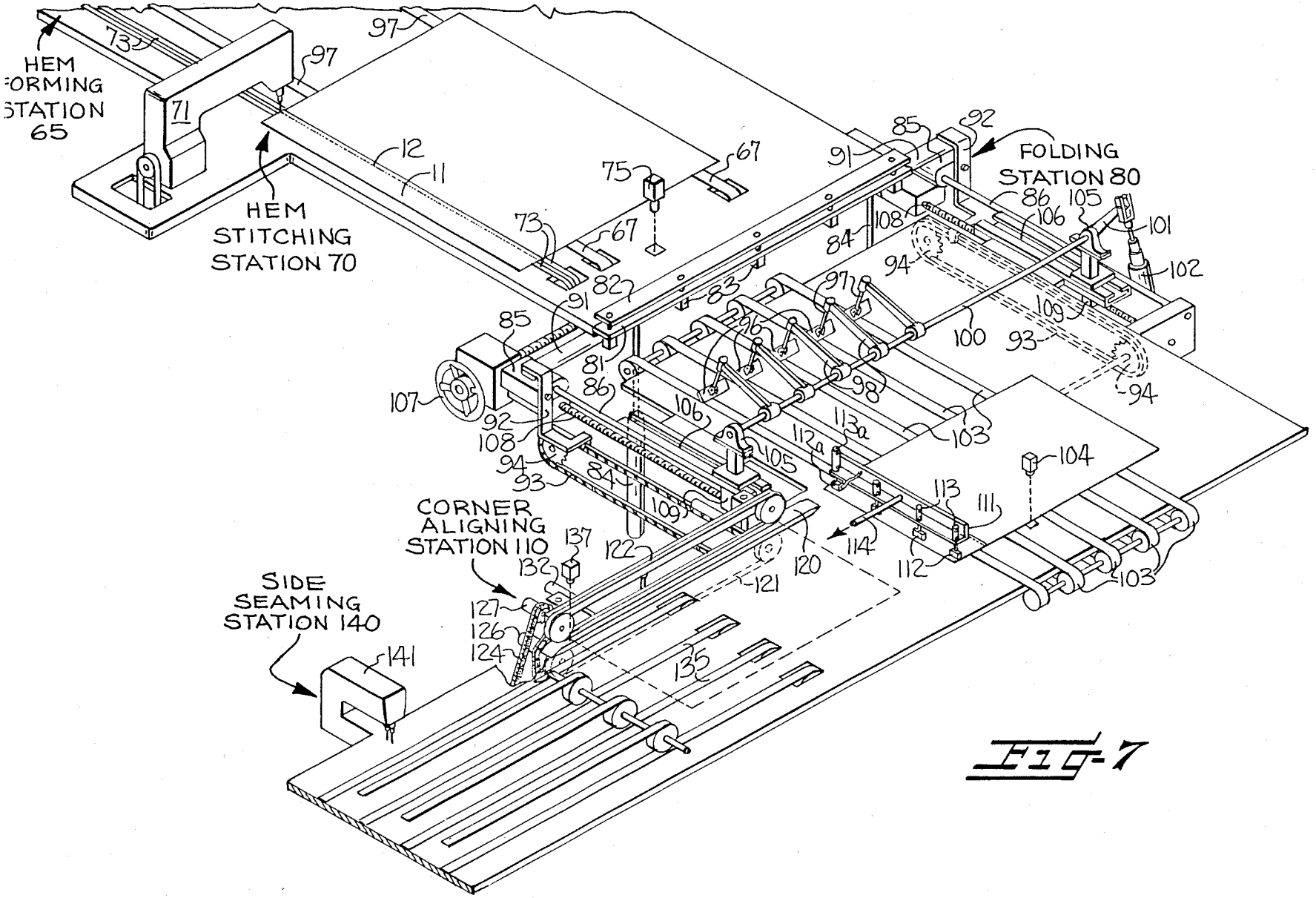
FIG. 7 is a fragmentary isometric view of the center folding station, corner aligning station, side seaming station and adjacent portions of the apparatus.

Detector means, in the form of a photoelectric cell 75, detects the completion of the sewing of the hem 11 (FIG. 7). A time delay-relay mechanism is controlled by the photoelectric cell 75 and permits the leading side edge of the hemmed pillowcase blank to be properly positioned in a clamping member of the center folding station, broadly indicated at 80, at which time the movement of the conveyor belts 67, 73 is stopped. The center folding station 80 operates in timed relationship to the other operations of the apparatus to successively receive the hemmed blanks from the hem stitching station 70 and fold the blanks along a fold line extending longitudinally along the medial portion of the blank with the opposite side edges and the hemmed end in overlying alignment with one another.

Figure 8:
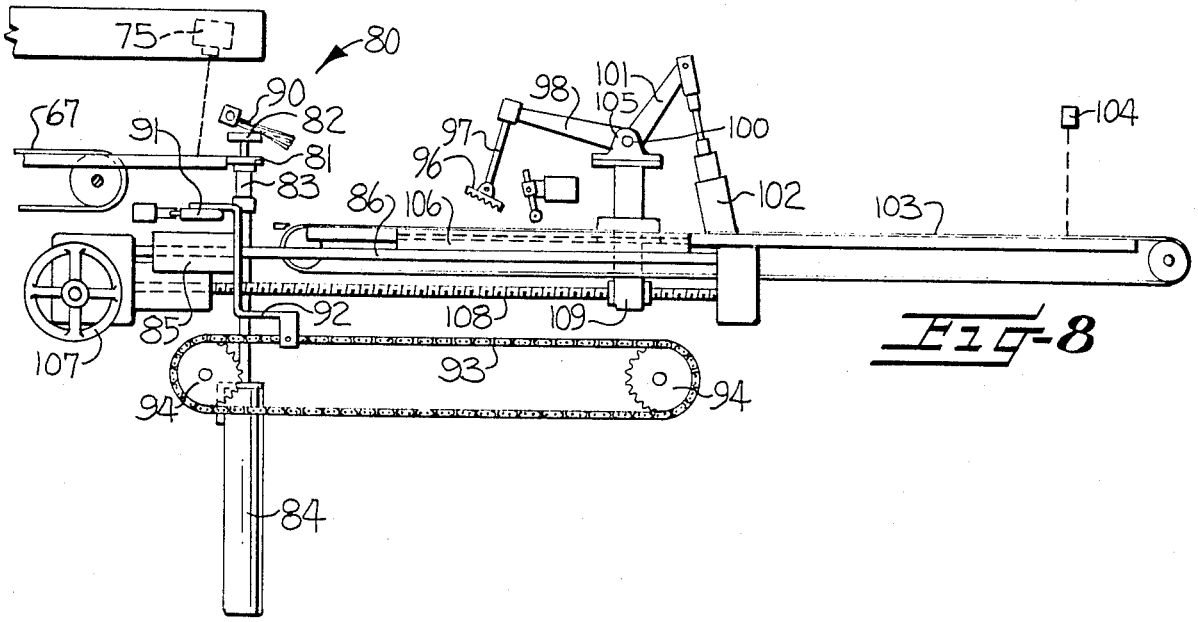
FIGS. 8–11 are vertical sectional views illustrating the sequential steps of the folding of the blanks along a fold line extending transversely along the medial portion of the blank in the center folding station.
Figure 9:
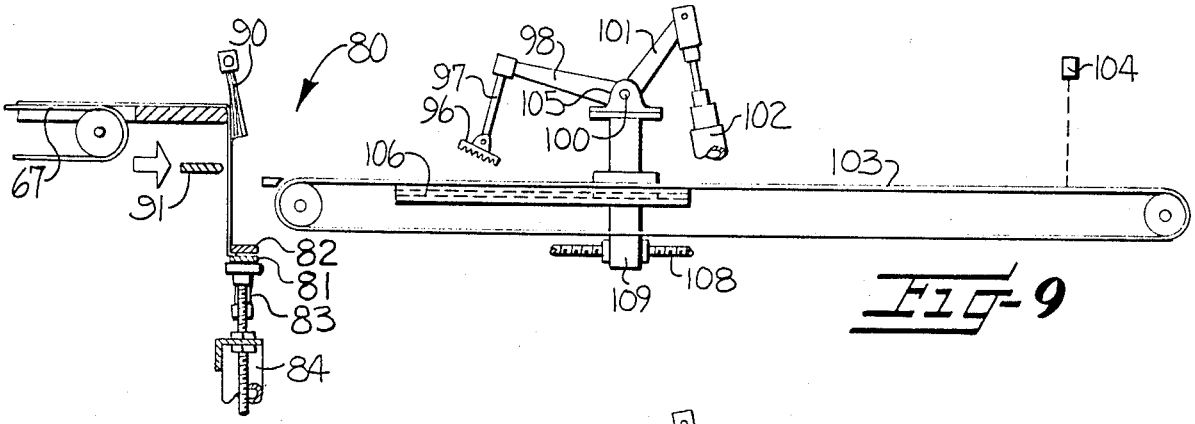

The center folding station 80 includes vertically reciprocating clamp means including a lower clamping bar 81 and an upper clamping bar 82 (FIGS. 7–11). The upper clamping bar 82 is supported for movement toward and away from the lower clamping bar 81 by spaced apart air cylinders 83 and the lower clamping bar 81 is supported on the upper ends of the piston rods of spaced apart air cylinders 84 (FIG. 8). The lower and upper clamping bars 81, 82 are in the open position as shown in FIG. 8 when the leading side edge of the pillowcase blank is moved therebetween and stopped. The air cylinders 83 are then operated to move the upper clamping bar 82 downwardly to clamp the blank against the lower clamping bar 81 and the air cylinders 84 then operate to lower the clamping bars 81, 82 downwardly to position shown in FIG. 9 so that the leading portion of the side edge of the blank extends in a vertical position.

Figure 10:
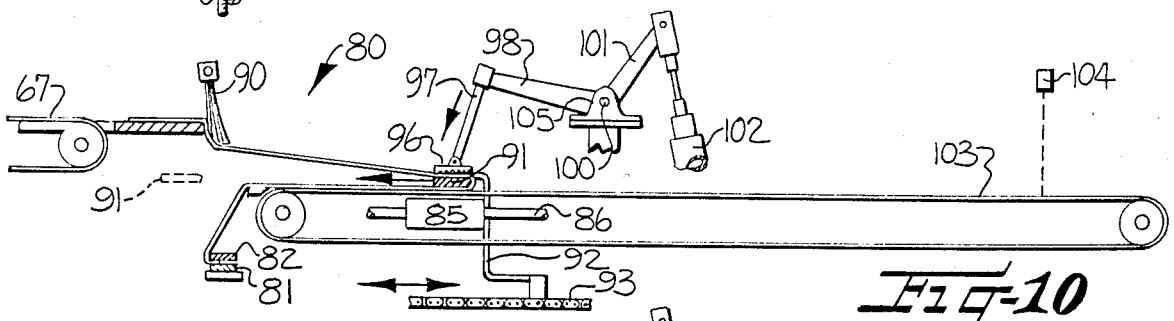

A transversely extending pivoted brush 90 is provided to engage the pillowcase blank as it is drawn downwardly over the edge of the support table and maintains the vertically extending portion under tension. A horizontally reciprocating folding bar 91 is supported at opposite ends on support brackets 92 (FIG. 7), the lower ends of which are fixed to conveyor chains 93 extending around sprockets 94. The medial portions of the brackets 92 are fixed to slide blocks 85 supported for sliding movement on slide rods 86. The sprockets 94 are rotated in opposite directions to reciprocate the folding bar 91 between the solid line and dotted line positions shown in FIG. 10. Thus, the folding bar 91 is engageable with one side of the vertically extending portion of the pillowcase blank for moving the same horizontally a predetermined distance to begin the folding of the blank, as shown in FIG. 10.

Clamping bars 96 are pivotally supported on the lower ends of rods 97, the upper ends of which are fixed in the outer ends of control arms 98, the inner ends of which are fixed on a pivot shaft 100. The pivot shaft 100 is suitably supported for rocking movement by a control arm 101 actuated by an air cylinder 102.

Figure 11:
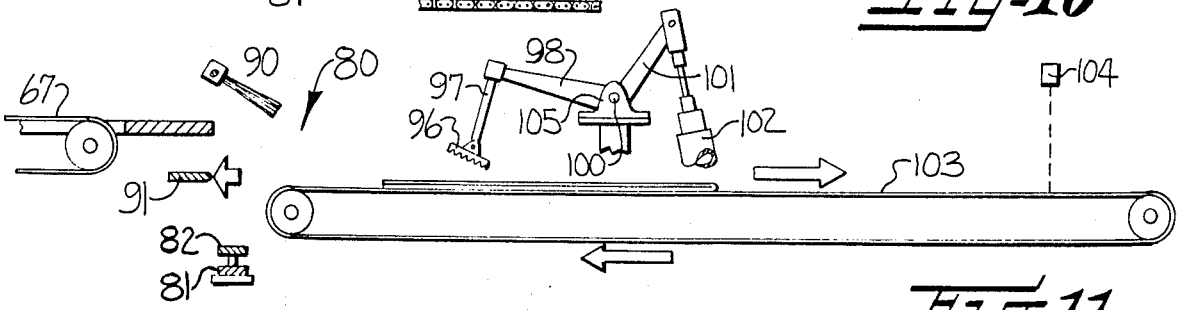

The pivot shaft 100 is supported for back and forth adjustment in the upper ends of bearing stands 105, the lower ends of which are supported for sliding movement in slides 106 (FIG. 7). The bearing stands 105 are moved back and forth by rotating a hand wheel 107 (FIG. 8) drivingly connected to threaded adjustment rods 108 which are threadably connected to connector arms 109 fixed at their upper ends to the bearing stands 105. The folding bar 91 moves the partially folded blank onto the upper table surface of the frame and onto spaced conveyor belts 103 (FIG. 7). The air cylinder 102 is operated to move the clamping bars 96 downwardly into engagement with the upper surface of the folded blank, above the folding bar 91, to retain the portion of the blank adjacent the fold line in position while the folding bar 91 is removed to the left, as illustrated in FIG. 10. The clamping bars 96 then maintain the folded edge portion of the blank in contact with the upper surface of the conveyor belts 103 and the clamping bars 81, 82 are separated to free the leading side edge thereof while the conveyor belts 103 move to the right and complete the folding of the blank, as shown in FIG. 11. The conveyor belts 103 then move the folded blank in a widthwise direction to a position, as shown in FIG. 7, where the folded blank is in position for movement in a lengthwise direction beyond the folding station 80. A photoelectric cell 104 (FIG. 7) is positioned to detect the leading folded edge of the blank and to stop operation of the conveyor belts 103 when the blank is in the proper position.

A corner aligning station, broadly indicated at 110, is positioned downstream of the folding station 80 for detecting and correcting an out of alignment condition of the leading ends of the hemmed end of the pillowcase blank and the overlying opposite side edges. The corner aligning station 110 is provided with means for selectively advancing the upper and lower hemmed ends and overlying opposite side edges and for aligning the leading ends thereof.

Figure 12:
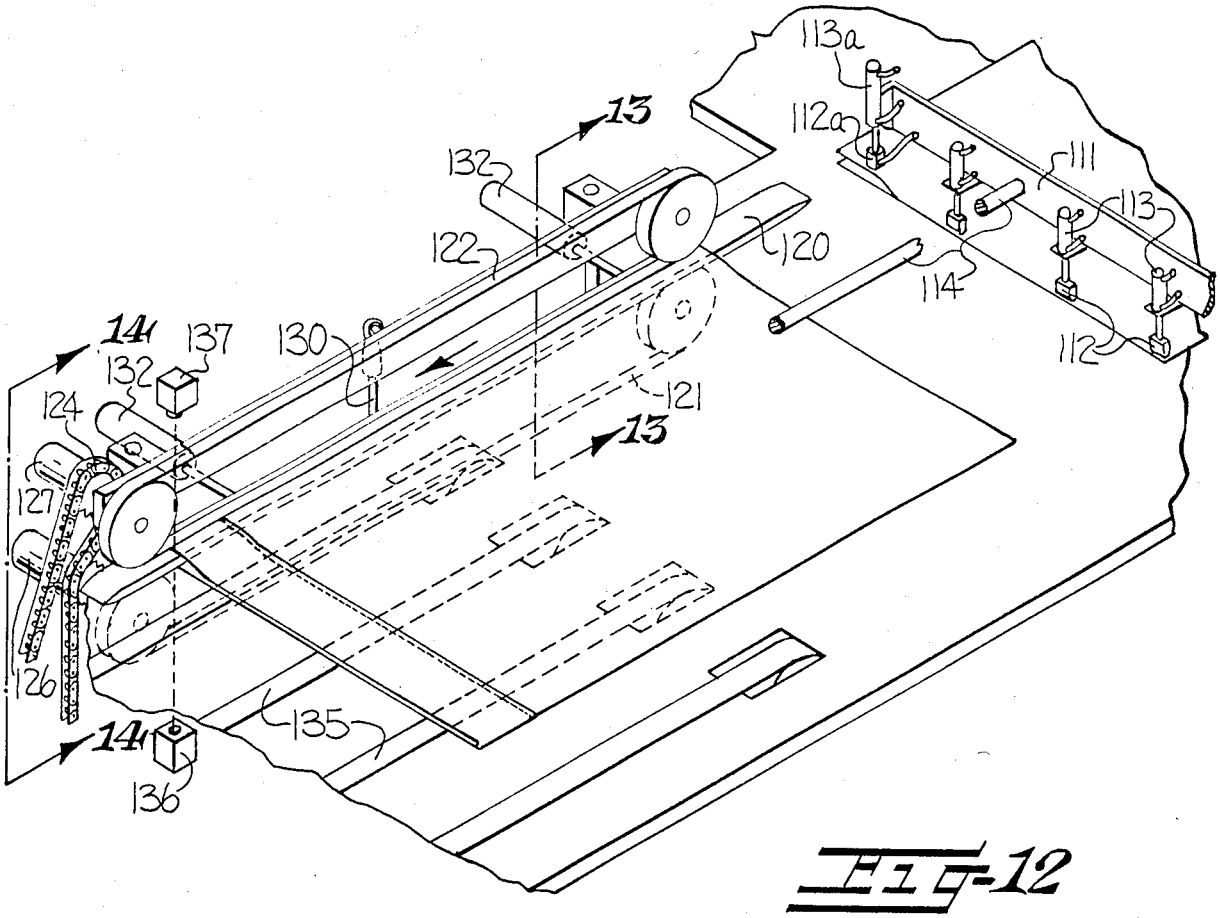
FIG. 12 is an isometric view of the corner aligning station, with parts broken away for purpose of clarity.

The pillowcase blank is moved in a lengthwise direction and into the corner aligning station 110 by means of a conveying rake device, best illustrated in FIG. 12, and including a transverse support bar 111 supporting a plurality of pressure heads 112 fixed on the lower ends of the piston rods of air cylinders 113. An air cylinder 113*a* is fixed on the support bar 111 and supports a suction head 112*a* for vertical movement, for purposes to be presently described. The support bar 111 is moved back and forth by a piston rod 114 of an air cylinder, not shown, which operates in timed relationship to the other mechanisms of the pillowcase forming apparatus.

Figure 13:
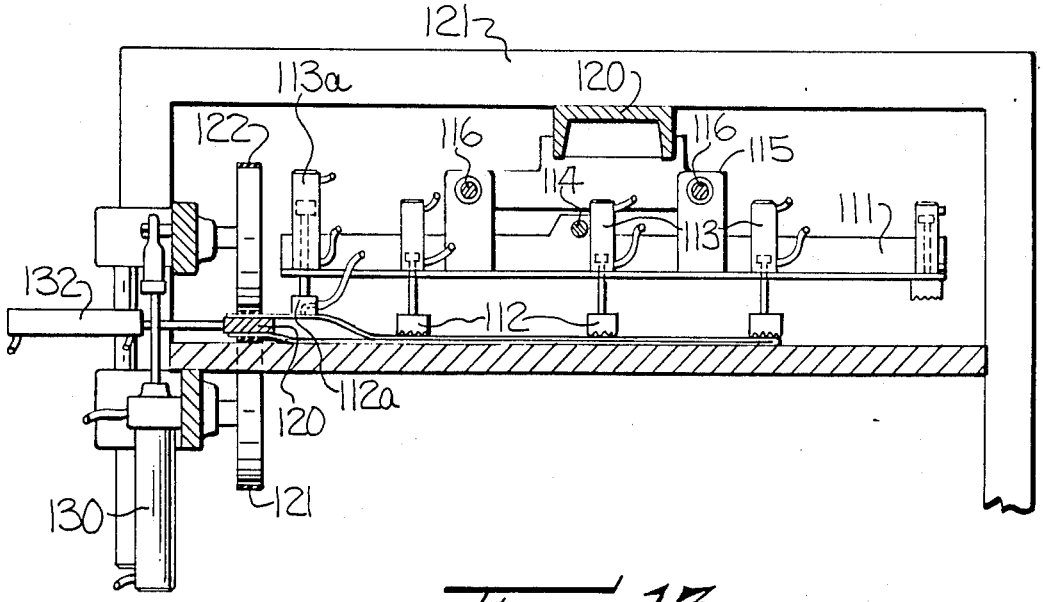
FIG. 13 is a vertical sectional view taken substantially along the line 13—13 in FIG. 12.
Figure 14:
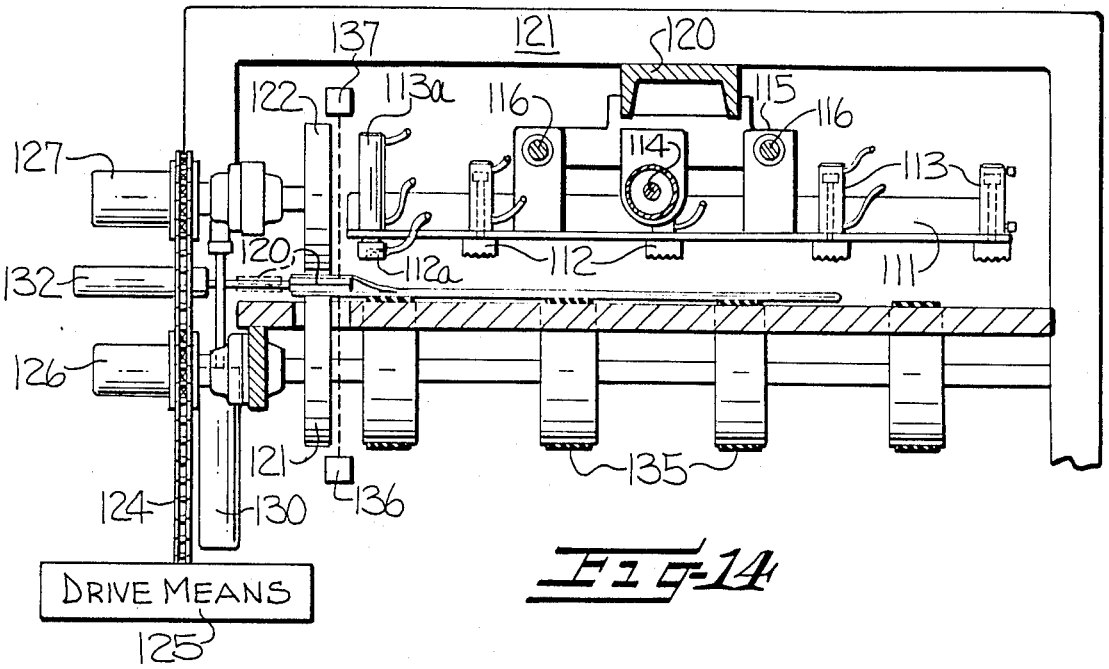
FIG. 14 is a vertical sectional view taken substantially along the line 14—14 in FIG. 12.

As illustrated in FIGS. 13 and 14, the support bar 111 is supported on a substantially inverted U-shaped carriage 115 which is mounted for sliding movement on spaced apart support rods 116 extending above the upper surface of the support table of the frame. The slide rods 116 are supported on a longitudinally extending support beam 120 which is in turn fixed on an inverted U-shaped frame 121 extending across the table of the frame.

As the leading hemmed end of the folded pillowcase blank is moved toward the corner aligning station 110 by the pressure heads 112, carried by the conveying rake device, the upper layer of the left hand corner of the hemmed end is raised in spaced relationship above the lower layer, as illustrated in FIG. 12, by the suction head 112*a* to guide the leading edges of the side edge portions of the folded blank into respective positions above and below a retractable guide bar 120, forming a part of the corner aligning station 110.

The corner aligning station 110 includes a selectively driven lower conveyor belt 121 supported and positioned so that its upper reach engages the lower surface of the side edge portion of the lower layer of the folded pillowcase blank and maintain the same in frictional engagement with the lower surface of the slide bar 120. A selectively driven upper conveyor belt 122 is aligned above the lower conveyor belt 121 and positioned so that its lower reach engages the upper surface of the side edge portion of the upper layer of the folded pillowcase blank to maintain the same in engagement with the upper surface of the retractable guide bar 120. The conveyor belts 121, 122 are selectively driven by a sprocket chain 124 connected to suitable drive means 125 (FIG. 14) and engageable with drive sprockets which are selectively connected to the drive shafts of the corresponding drive pulleys of the conveyor belts 121, 122 by electrically controlled pneumatic clutch devices 126, 127. The upper conveyor belt 122 is supported for vertical movement toward and away from the lower conveyor belt 121 by means of air cylinders 130 (FIGS. 13 and 14) and the retractable drive bar 120 is supported for movement between the solid and dotted line positions shown in FIG. 14, by means of spaced air cylinders 132 (FIG. 12).

As the pillowcase blank is moved lengthwise by the conveying rake device, the lower and upper layers of the side portions of the pillowcase blank are moved along the respective lower and upper surfaces of the retractable guide bar 120, and the pillowcase blank is moved along the upper reaches of space conveyor belts 135. Respective lower and upper detector means, in the form of photoelectric cells 136, 137, are positioned for detecting the relative positions of the respective lower and upper leading edges of the folded pillowcase blank (FIGS. 12 and 14) and are operable to control movement of the lower and upper conveyor belts 121, 122, by means of the clutch devices 126, 127, to vertically align the leading edges of the lower and upper layers of the pillowcase blank before the pillowcase blank leaves the corner aligning station 110. This is accomplished by lowering the conveyor belt 122 by means of the air cylinder 130. When the leading edges of the folded blank are vertically aligned, the retractable slide bar 120 is removed from between the conveyor belts 121, 122 and the upper conveyor belt 122 is raised, by means of the air cylinders 130. The conveyor belts 135 convey the pillowcase blank out of the corner aligning station 110 and through a side seaming station, broadly indicated at 140 (FIG. 1).

The side seaming station 140 preferably includes a double needle sewing machine 141 which joins the aligned side edges of the pillowcase blank with an overedge stitch and a line of regular stitching, as indicated at 13 in FIG. 2. After the pillowcase blanks have passed through the side seaming station 140, being moved in a lengthwise direction by the conveyor belts 135, they are engaged and moved a further distance in a lengthwise direction by a conveying rake device, broadly indicated at 145 in FIG. 15. Detector means, in the form of a photoelectric cell 150 (FIG. 15), is provided for properly detecting and positioning the pillowcase blank at the end of its lengthwise travel. Suitable cutting means, not shown, is provided adjacent the side seam sewing machine 141 for cutting the stitch chain extending from the trailing end of the pillowcase.

A conveying rake device, broadly indicated at 160 (FIG. 15), is provided for engaging the stitched side edge portion of the pillowcase blank and moving the same onto and between lower spaced apart conveyor belts 161 and aligned upper conveyor belts 162 to move the pillowcase blank in a widthwise direction and through a bottom end seaming station, broadly indicated at 170. The bottom end seaming station, broadly indicated at 170, includes a sewing machine 171 which forms a row of overedge stitching, as indicated at 14 in FIG. 2, to close the bottom end of the pillowcase blank. Suitable cutting means, not shown, is provided adjacent the bottom seam sewing machine 171 for cutting the stitch chain extending from the trailing end of the pillowcase.

The stitched pillowcases are then successively moved to a counting and stacking station, broadly indicated at 180, for receiving the successive pillowcases from the bottom end seaming station 170 and positioning a predetermined number of the pillowcases in successive stacks.

Figure 15:
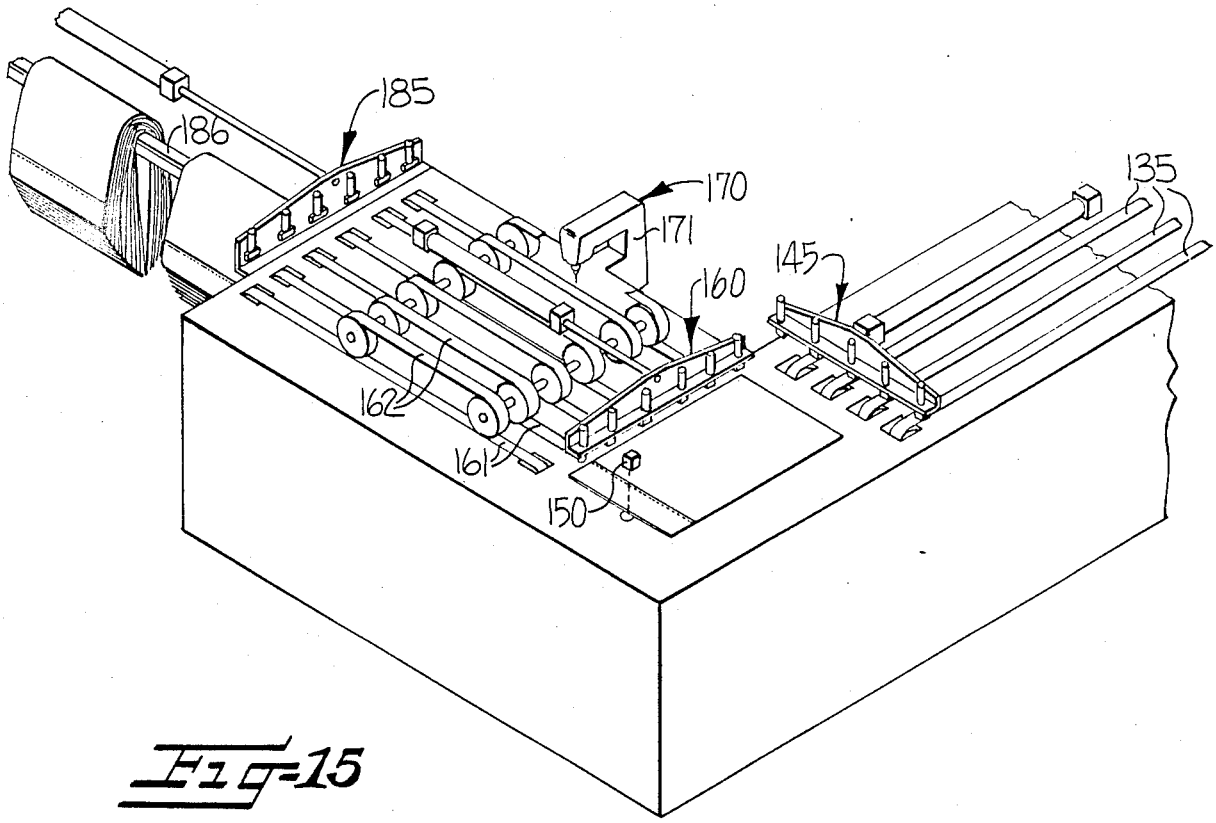
FIG. 15 is a fragmentary isometric view illustrating the bottom end seaming station and the counting and stacking station of the apparatus.

The counting and stacking station 180 includes first conveying means, in the form of a conveying rake device, broadly indicated at 185 in FIG. 15. The conveying rake device 185 has a clamping device to engage the seamed side edge portion of the pillowcase downstream of the bottom end seaming station 170 and moving the same a predetermined distance before releasing the successive pillowcases to form a stack thereof. The stack of pillowcases is deposited on second conveying means, in the form of a conveyor belt 186 (FIGS. 1 and 15). The conveyor belt 186 is supported for vertical movement and is operable to move a stack of a predetermined number of the pillowcases downstream of the stack on which the pillowcases are initially stacked by the first conveyor means. Movement of the conveyor belt 186 is carried out after a predetermined number of such pillowcases are deposited thereon from the pillowcase forming apparatus so that successive stacks of pillowcases are indexed and stacked along the conveyor belt 186 for removal by an operator.

The details of the pulleys, guide rod supports, tension mechanisms, drive means for the various conveyor belts, and other mechanisms are not illustrated and described in detail, but are of conventional construction. Because such mechanisms are conventional and well understood by those with ordinary skill in the art, a detailed disclosure thereof is not necessary for a full understanding of the present invention. Also, the various control mechanisms for sequentially controlling operation of the various stations of the apparatus, in timed relationship with each other, are not disclosed in detail since they are conventional and well understood by those with ordinary skill in the art and are not believed necessary for a full understanding of the present invention.

The pillowcase fabricating apparatus and method of the present invention automatically forms successive pillowcases from continuous open width textile fabric in an economical manner without requiring a large number of sewing machine operators and the like. Also, the present pillowcase fabricating apparatus includes a folding station for accurately folding the pillowcase blanks so that the opposite side edges are substantially aligned. A corner aligning station is provided to insure that the side seam is formed after the side edges have been positioned in accurately aligned position so that successive pillowcases of identical construction are formed by the apparatus and method of the present invention.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. An apparatus for successively fabricating pillowcases and the like comprising a supply source of continuous open width textile fabric with side edges along opposite sides thereof, means for successively withdrawing predetermined lengths of the textile fabric from said supply source and along a first path of travel in a lengthwise direction, a cutting station positioned in the longitudinal path of travel of the withdrawn predetermined lengths of textile fabric and including cutting means for transversely cutting the textile fabric into successive individual blanks of predetermined length, a hem folding station including means for receiving the individual blank and folding one cut end portion of the individual blanks over onto the remaining portion thereof, a hem stitching station including means for receiving the folded over end hem portion and sewing the hem, conveying means for successively moving the individual blanks along a horizontal second path of travel in a widthwise direction from said cutting station, through said hem folding station, and through said hem stitching station to form a hem along one end of the individual blank and extending between opposite side edges thereof, a folding station including means for successively receiving the hemmed blanks from said hem stitching station and folding the blanks along a fold line extending longitudinally along the medial portion of the blank with the opposite side edges and the hemmed end in substantial overlying alignment with one another, a corner aligning station including means for detecting an out of alignment condition of the leading ends of the hemmed end and overlying opposite side edges, for selectively advancing the upper and lower hemmed ends and overlying opposite side edges, and for aligning the leading ends thereof, a side seaming station including means for receiving the aligned side edges and sewing together the leading folded hem portions and the trailing side edges, conveying means for successively moving the individual blanks along a third horizontal path of travel in a lengthwise direction and from said folding station, through said corner aligning station, and through said side seaming station, a bottom end seaming station including means for receiving and sewing together the overlying bottom ends of the successive blanks, and conveying means for successively moving the individual blanks along a fourth horizontal path of travel in a widthwise direction through and beyond said bottom end seaming station.

2. An apparatus, according to claim 1, including a counting and stacking station including means for receiving the successive pillowcases from said bottom end seaming station and positioning a predetermined number of said pillowcases in a stack.

3. An apparatus, according to claim 1, wherein said means for successively withdrawing predetermined lengths of the textile fabric comprises feed roll means positioned adjacent said supply source and operable to withdraw predetermined lengths of the fabric from said supply source in timed relationship to the operation of said cutter means, and fabric accumulator and tension means positioned downstream of said feed roll means for receiving and maintaining predetermined tension in the fabric.

4. An apparatus, according to claim 1, wherein said cutting station includes reciprocating fabric clamping means for clamping the leading end of the fabric and moving the same a predetermined distance beyond said cutting means, and fixed fabric clamping means positioned immediately upstream of said cutting means for transversely engaging and holding the fabric while the fabric is being tranversely cut.

5. An apparatus, according to claim 1, wherein said folding station comprises vertically reciprocating clamp means for engaging and clamping the leading side edge of successive blanks and drawing the same downwardly a predetermined distance, horizontally reciprocating fold bar means engageable with one side of the vertically extending portion of said blank for moving the same horizontally a predetermined distance to begin the folding of the blank, clamp means for engaging the partially folded blank in the area of said fold bar to permit said fold bar to return to its original position, and conveying means cooperating with said clamping means for removing the leading side of the blank from said vertically reciprocating clamping means and completing the folding of the blank.

6. An apparatus, according to claim 1, wherein said corner aligning station comprises a selectively driven lower conveyor belt positioned to engage the lower surface of the side edge portion of the lower layer of the folded blank, a selectively driven upper conveyor belt aligned above said lower conveyor belt and positioned to engage the upper surface of the side edge portion of the upper layer of the folded blank, retractable bar means positioned between said lower and upper conveyor belts for engaging the inner surfaces of the lower and upper layers of the side edge portions of the folded blank, means for separating the leading edges of the side edge portions of the folded blank to guide the same into respective positions above and below said retractable bar means and for engagement by said lower and upper conveyor belts, and respective lower and upper detector means for detecting the relative positions of the respective lower and upper leading edges of the folded blank being conveyed on the respective lower and upper surfaces of said retractable bar means, said detector means being operable to respectively control the movement of said lower and upper conveyor belts to vertically align the respective leading edges of the lower and upper layers of the blank.

7. An apparatus, according to claim 2, wherein said counting and stacking station comprises first conveying means for engaging the seamed side edge portion of successive pillowcases downstream of said bottom end seaming station and for moving the same a predetermined distance before releasing the same and forming a stack thereof, and second conveying means onto which said stack of pillowcases is deposited by said first conveying means and being operable to move a stack of a predetermined number of the pillowcases downstream of the stack on which the pillowcases are initially stacked by said first conveyor means.

8. An apparatus for successively fabricating pillowcases and the like comprising a supply source of continuous open width textile fabric with side edges along opposite sides thereof, means for successively withdrawing predetermined lengths of the textile fabric from said supply source, a cutting station positioned in the path of travel of the withdrawn predetermined lengths of textile fabric and including cutting means for transversely cutting the textile fabric into successive individual blanks of predetermined length, a hem forming station including means for receiving the individual blanks and folding one cut end portion of the individual blanks over onto the remaining portion thereof, a hem stitching station including means for receiving the folded over end hem portion and sewing the hem, conveying means for successively moving the individual blanks in a sidewise direction from said cutting station, through said hem forming station, and through said hem stitching station to form a hem along one end of the individual blank and extending between opposite sides thereof, a folding station including means for successively receiving the hemmed blanks from said hem stitching station and folding the blanks along a fold line extending transversely along the medial portion of the blank with the opposite side edges and the hemmed end in substantial overlying alignment with one another, a corner aligning station including means for detecting an out of alignment condition of the leading ends of the hemmed end and overlying opposite side edges, for selectively advancing the upper and lower hemmed ends and overlying opposite side edges, and for aligning the leading ends thereof, a side seaming station including means for receiving the aligned side edges and sewing together the leading folded hem portions and the trailing side edges, conveying means for successively moving the individual blanks in a lengthwise direction and from said folding station, through said corner aligning station, and through said side seaming station, a bottom end seaming station including means for receiving and sewing together the overlying bottom ends of the successive blanks, a counting and stacking station positioned for receiving the successive pillowcases from said bottom end seaming station and positioning a predetermined number of said pillowcases in successive stacks, and conveying means for successively moving the individual blanks in a sidewise direction and through said bottom end seaming station and to said counting and stacking station.

9. An apparatus, according to claim 1 or 8, wherein said folding station comprises vertically reciprocating clamp means for engaging and clamping the leading side edge of successive blanks and drawing the same downwardly a predetermined distance, horizontally reciprocating fold bar means engageable with one side of the vertically extending portion of said blank for moving the same horizontally a predetermined distance to begin the folding of the blank, clamp means for engaging the partially folded blank in the area of said fold bar to permit said fold bar to return to its original position, and conveying means cooperating with said clamp means for removing the leading side of the blank from said vertically reciprocating clamping means and completing the folding of the blank; and said corner aligning station comprises a selectively driven lower conveyor belt positioned to engage the lower surface of the side edge portion of the lower layer of the folded blank, a selectively driven upper conveyor belt aligned above said lower conveyor belt and positioned to engage the upper surface of the side edge portion of the upper layer of the folded blank, retractable bar means positioned between said lower and upper conveyor belts for engaging the inner surfaces of the lower and upper layers of the side edge portions of the folded blank, means for separating the leading edges of the side edge portions of the folded blank to guide the same into respective positions above and below said retractable bar means and for engagement by said lower and upper conveyor belts, and respective lower and upper detector means for detecting the relative positions of the respective lower and upper leading edges of the folded blank being conveyed on the respective lower and upper surfaces of said retractable bar means, said detector means being operable to respectively control the movement of said lower and upper conveyor belts to vertically align the respective leading edges of the lower and upper layers of the blank.

10. In an apparatus for successively fabricating textile fabric articles, such as pillowcases and the like, including means for successively supplying generally rectangular blanks for such fabrication; the combination therein of a folding means positioned for successively receiving the blanks and folding the blanks along a fold line extending transversely along the medial portion of the blank with opposite side edges and end edges in substantially overlying alignment with one another, said folding means comprising vertically reciprocating clamp means for engaging and clamping the leading side edge of successive blanks and drawing the same downwardly a predetermined distance, horizontally reciprocating fold bar means engageable with one side of the vertically extending portion of the blank for moving the same horizontally a predetermined distance to begin the folding of the blank, clamp means for engaging the partially folded blank in the area of said fold bar to permit said fold bar to return to its original position, and conveying means cooperating with said clamping means for removing the leading side of the blank from said vertically movable reciprocating clamp means and completing the folding of the blank.

11. In an apparatus for successively fabricating textile articles, as set forth in claim 10, further including corner aligning means for detecting an out of alignment condition of the leading end edges of a corner of the folded blank and for selectively advancing the upper and lower leading end edges at the corner of the folded blank to align the leading end edges at the corner thereof, said corner aligning means comprising a selectively driven lower conveyor belt positioned to engage the lower surface of the side edge portion of the lower layer of the folded blank, a selectively driven upper conveyor belt aligned above said lower conveyor belt and positioned to engage the upper surface of the side edge portion of the upper layer of the folded blank, retractable bar means positioned between said lower and upper conveyor belts for engaging the inner surfaces of the lower and upper layers of the side edge portions of the folded blank, means for separating the leading edges of the side edge portions of the folded blank to guide the same into respective positions above and below said retractable bar means and for engagement by said lower and upper conveyor belts, and respective lower and upper detector means for detecting the relative positions of the respective lower and upper leading edges of the folded blank being conveyed on the respective lower and upper surfaces of said retractable bar means, said lower and upper detector means being operable to respectively control the movement of said lower and upper conveyor belts to vertically align the respective leading edges of the lower and upper layers of the blank.

12. Folding means, suitable for use in an apparatus for successively fabricating textile articles such as pillowcases and the like from generally rectangular blanks of textile material, and for successively receiving the blanks and folding the blanks along a fold line extending transversely along the medial portion of the blank with opposite side edges and end edges in substantial overlying alignment with one another; said folding means comprising vertically reciprocating clamp means for engaging and clamping the leading side edge of successive blanks and drawing the same downwardly a predetermined distance, horizontally reciprocating fold bar means engageable with one side of the vertically extending portion of the blank for moving the same horizontally a predetermined distance to begin the folding of the blank, clamp means for engaging the partially folded blank in the area of said fold bar to permit said fold bar to return to its original position, and conveying means cooperating with said clamping means for removing the leading side of the blank from said vertically movable reciprocating clamp means and completing the folding of the blank.

13. Corner aligning means, suitable for use in apparatus for successively fabricating textile articles such as pillowcases or the like from generally rectangular blanks of textile material which have been folded along a fold line extending transversely along the medial portion of the blank with the opposite side edges and the end edges in substantially overlying alignment with one another, and for detecting an out of alignment condition of the leading end edges of a corner of the folded blank and for selectively advancing the upper and lower leading edges at the corner of the folded blank to align the leading end edges at the corner thereof; said corner aligning means comprising a selectively driven lower conveyor belt positioned to engage the lower surface of the side edge portion of the lower layer of the folded blank, a selectively driven upper conveyor belt aligned above said lower conveyor belt and positioned to engage the upper surface of the side edge portion of the upper layer of the folded blank, retractable bar means positioned between said lower and upper belts for engaging the inner surface of the lower and upper layers of the side edge portions of the folded blank, means for separating the leading edges of the side edge portions of the folded blank to guide the same into respective positions above and below said retractable bar means and for engagement by said lower and upper conveyor belts, and respective lower and upper detector means for detecting the relative positions of the respective lower and upper leading edges of the folded blank being conveyed on the respective lower and upper surfaces of said retractable bar means, said lower and upper detector means being operable to respectively control the movement of said lower and upper conveyor belts to vertically align the respective leading edges of the lower and upper layers of the blank.

14. Folding and corner aligning means, suitable for use in an apparatus for successively fabricating textile fabric articles such as pillowcases and the like from generally rectangular blanks of textile material, in which:

said folding means successively receives the blanks and folds the blanks along a fold line extending transversely along the medial portion of the blank with the opposite side edges and end edges in substantially overlying alignment with one another and comprises vertically reciprocating clamp means for engaging and clamping the leading side edge of successive blanks and drawing the same downwardly a predetermined distance, horizontally reciprocating fold bar means engageable with one side of the vertically extending portion of the blank for moving the same horizontally a predetermined distance to begin the folding of the blank, clamp means for engaging the partially folded blank in the area of said fold bar to permit said fold bar to return to its original position, and conveying means cooperating with said clamping means for removing the leading side of the blank from said vertically movable reciprocating clamp means and completing the folding of the blank; and said corner aligning means detects out of alignment condition of the leading end edges of a corner of the folded blank and selectively advances the upper and lower leading end edges at the corner of the folded blank to align the leading end edges at the corner thereof and comprises a selectively driven lower conveyor belt positioned to engage the lower surface of the side edge portion of the lower layer of the folded blank, a selectively driven upper conveyor belt aligned above said lower conveyor belt and positioned to engage the upper surface of the side edge portion of the upper layer of the folded blank, retractable bar means positioned between said lower and upper belts for engaging the inner surface of the lower and upper layers of the side edge portions of the folded blank, means for separating the leading edges of the side edge portions of the folded blank to guide the same into respective positions above and below said retractable bar means and for engagement by said lower and upper conveyor belts, and respective lower and upper detector means for detecting the relative positions of the respective lower and upper leading edges of the folded blank being conveyed on the respective lower and upper surfaces of said retractable bar means, said lower and upper detector means being operable to respectively control the movement of said lower and upper conveyor belts to vertically align the respective leading edges of the lower and upper layers of the blank.

* * * * *